United States Patent [19]

Speer

[11] 4,448,130

[45] May 15, 1984

[54] PACKAGING KIT FOR PYROTECHNIC MATERIALS LOADING

[75] Inventor: Spencer J. Speer, Ontario, Calif.

[73] Assignee: General Dynamics, Pomona Division, Pomona, Calif.

[21] Appl. No.: 398,724

[22] Filed: Jul. 15, 1982

[51] Int. Cl.[3] ..... F42B 13/20

[52] U.S. Cl. ..... 102/498; 102/335; 102/202.14

[58] Field of Search ..... 102/202.14, 204, 282, 102/314, 331, 335, 395, 444, 445, 513, 529, 498

[56] References Cited

U.S. PATENT DOCUMENTS

| | | |
|---|---|---|
| 777,319 | 12/1904 | Ulrich . |
| 797,218 | 8/1905 | Du Pont . |
| 931,723 | 8/1909 | Bird . |
| 958,990 | 5/1910 | Bourdelles . |
| 2,353,934 | 7/1944 | Schreib . |
| 2,410,435 | 11/1946 | Evans, Jr. . |
| 2,432,706 | 12/1947 | Anderson et al. . |
| 3,179,051 | 4/1965 | Morse . |
| 3,276,378 | 10/1966 | Gahle . |
| 3,282,215 | 11/1966 | Roth . |
| 3,323,456 | 6/1967 | Rothman . |
| 3,399,622 | 9/1968 | Houdek . |
| 3,771,459 | 11/1973 | Lohnstein . |
| 3,908,364 | 9/1975 | LeFebvre et al. . |

*Primary Examiner*—Charles T. Jordan
*Assistant Examiner*—Ted L. Parr
*Attorney, Agent, or Firm*—Henry M. Bissell; Edward B. Johnson

[57] ABSTRACT

A preformed cup for receiving and retaining pyrotechnic materials including provision for hermetic sealing against entry of disabling matter and moisture, to be inserted, after sealing, into a conventional casing in such manner as to maintain close proximity with ignition devices as provided in standard pyrotechnic systems. Close proximity of the contained pyrotechnic materials to an associated igniter is permissible with safety, regardless of the volume of material loaded or the "G" loads encountered. The device permits loading of hazardous pyrotechnic materials on an off-line basis, independently of final assembly of devices used as practice rounds in anti-armor missiles and the like.

17 Claims, 3 Drawing Figures

PACKAGING KIT FOR PYROTECHNIC MATERIALS LOADING

BACKGROUND OF THE INVENTION

1. Field of the Invention

This invention relates generally to packaging of explosive materials and, more particularly, to the safe packaging of pyrotechnic materials which are extremely hazardous to work with.

2. Description of the Prior Art

The present invention has been developed as a way of reducing the hazard of mass producing practice rounds for a particular anti-armor missile in a production line facility. The missile in question is designed to be fired from a shoulder-held launcher, somewhat in the nature of the bazooka of World War II. The missile is packaged with the launcher, and the launcher is designed to be discarded after a single use. As developed, the missile and launcher combination is extremely effective when used by trained personnel.

Naturally, however, the actual missiles are too costly to be used in providing effective training of troops, since the training requires the firing of a substantial number of rounds before a soldier can become proficient in use of the weapon. For training purposes, a sub-caliber round is used which is launched from a cylinder equivalent to the standard missile launcher and which carries a pyrotechnic charge which produces a flash and explosion upon impact. Thus, the training round simulates the trajectory and effect of use of the real missile, thereby enabling the training of troops to become proficient in use of the weapon at a fraction of the cost which would be involved if the actual missiles were used.

For use in the training of troops, many thousands of training round launchers are required and the sub-caliber rounds are needed in the millions. This calls for a production line facility to manufacture them. However, the nature of the pyrotechnic materials employed in the training rounds is such that it is essential to provide off-line loading of the materials to form the pyrotechnic charge. The pyrotechnic charge, which may comprise a plurality of different ingredients, must be placed in the training round during production. The ingredients have an extremely low flash point and are very sensitive to heat or static charge developed from the frictional movement of the particles. It is desirable to restrict the particle movement to minimize the hazard of explosion from this source, particularly during handling on the manufacturing assembly line. Furthermore, it is desirable to be able to prepare the pyrotechnic charge in a facility away from the production line where the sub-caliber rounds are being assembled and manufactured so that the pyrotechnic materials can be handled in small quantities, thus reducing the hazard of a manufacturing plant explosion if a mishap does occur.

The loading of training rounds with pyrotechnic materials in conventional fashion is so hazardous that few, if any, of the known pyrotechnic manufacturing plants are willing to undertake the project. In one instance, a three-part pyrotechnic compound is employed and the conventional production technique is to drop the ingredients into the semi-manufactured training round, after which the round and contents are vibrated to produce the desired mixing of ingredients. With the materials needed for this purpose, this is extremely hazardous.

Known prior art techniques and apparatus provide very little assistance in attempting to solve this problem. The packaging of gun powder in bags, particularly for use with large-caliber guns, has been a common practice for many years. Indeed, this practice is employed at the present time with large naval guns, where the projectile is loaded into the barrel first, followed by the placing of a selected number of bags of powder into the firing chamber before the breach is closed. This permits the amount of powder used for a given firing of the gun to be tailored to the type of round, the distance to the target, etc. Thus, examples of the use of bags of various types for containing powder in, or in conjunction with, rounds for guns may be found in U.S. Pat. Nos. 777,319 of Ulrich, 797,218 of Du Pont, 2,353,934 of Schreib, 2,410,435 of Evans, Jr., 2,432,706 of Anderson et al, 3,276,378 of Gahle, and 3,771,459 of Lohnstein. Most of these involve cloth bags of various types and configurations, some having particular facility for ease in filling or for special purposes related to the use of the guns. Bourdelles, in U.S. Pat. No. 958,990, discloses the use of blocks of powder as a means of propulsion for a submarine torpedo, the blocks being maintained in the fabricated form by virtue of their being encased in a sheath of rubber stretched around the powder. The Schreib patent discloses the use of a cellophane bag which, after filling with the powder or other explosive mixture, has its mouth portion wrapped closed and stuck together. This device is said to have the capability of protecting its contents against the ingress of moisture, thus lessening the effects of moisture on the powder, and also of serving as a coating to the interior of the shell in which the bag is installed and providing a means for preventing frictional movement of the powder in the shell.

Other arrangements for encasing the contents of a shell are disclosed in U.S. Pat. Nos. 931,723 of Bird, 3,179,051 of Morse, and 3,399,622 of Houdek. The arrangements of Bird and Morse actually relate to a case for the shot of a shotgun shell, rather than for the powder. The casing of Houdek is designed for insertion within a shotgun shell in order to make the shell reloadable.

None of these examples of the prior art are considered suitable solutions to the problem to which the present invention is directed.

SUMMARY OF THE INVENTION

In brief, arrangements in accordance with the present invention comprise a packaging kit for pyrotechnic materials in which the pyrotechnic material is hermetically sealed, thus preventing the ingress of moisture and other contaminating foreign materials. Preferably, arrangements in accordance with the invention comprise a thin-walled, preformed Mylar cup of a generally cylindrical shape and closed at one end. Mylar is a registered trademark of the Dupont Corporation and refers to polyester film. The pyrotechnic material is placed in the cup until the cup is filled. Thus, the cup is designed to provide the volume required for the desired pyrotechnic charge. The pyrotechnic materials are packed into the cup to the requisite weight and volume so as to develop the desired bulk density. A Mylar or polyethylene sheet cover is placed over the top as a lid and is bonded, heat-sealed or ultrasonically welded to complete the enclosure with a hermetic seal.

The packaging kit of the invention also includes a generally cylindrical casing or body for supporting the cup during handling and ultimate insertion into the shell of the training round. The Mylar cup is slightly smaller in diameter than the inside diameter of the casing and has an outwardly projecting, circumferential lip at its juncture with the lid of the cup which serves to position the cup with its contents within the casing adjacent the end in which it is inserted. The casing may be formed of thin metal or it may be of plastic or the like having walls thicker than the Mylar of the cup and sufficiently strong to protect the cup and contents when situated within the casing. After the cup with its pyrotechnic material contents is inserted within the casing, a disc-like plug is inserted into frictional engagement with the open end of the casing. This pushes the cup slightly farther into the casing and deforms the circumferential lip of the cup into the very limited space between the plug and the inner wall of the casing, thus gripping this lip and serving to retain the cup within the casing immediately adjacent the plug. Any projecting portion of this lip is then trimmed to avoid possible interference with proper placement of the pyrotechnic charge sub-assembly in the round for which it is designed.

The end of the casing remote from the plug is substantially closed, except for a central opening into which an igniter is placed. This igniter may be a pyrotechnic primer cap where the pyrotechnic material is to be ignited by a firing pin. Alternatively, this igniter may be an electrically ignited squib when the firing is to be initiated by an electrical pulse. Both such techniques for igniting a powder charge are known in the art.

When assembled in this fashion, the charge sub-assembly formed from the packaging kit of the invention may be more safely handled as an integral unit than has heretofore been possible when the charge was placed loosely in the practice round. The pyrotechnic materials are confined within the cup so that they are much less capable of generating frictional heat or static electricity which might set off the charge. The casing serves to protect the thin Mylar cup from rupture during handling. The integral unit may thus be brought safely to the production line where the other components of the training rounds are being fabricated and assembled and may be installed very readily and safely with minimum hazard into the round.

Although the preferred embodiment of the present invention is desligned in a generally cylindrical configuration for use in training rounds of the type described, it may be modified to form other shapes or configurations adapted to fit other but similar needs with like beneficial results.

BRIEF DESCRIPTION OF THE DRAWINGS

A better understanding of the present invention may be had from a consideration of the following detailed description, taken in conjunction with the accompanying drawing in which.

DESCRIPTION OF THE PREFERRED EMBODIMENTS

Figure 1:
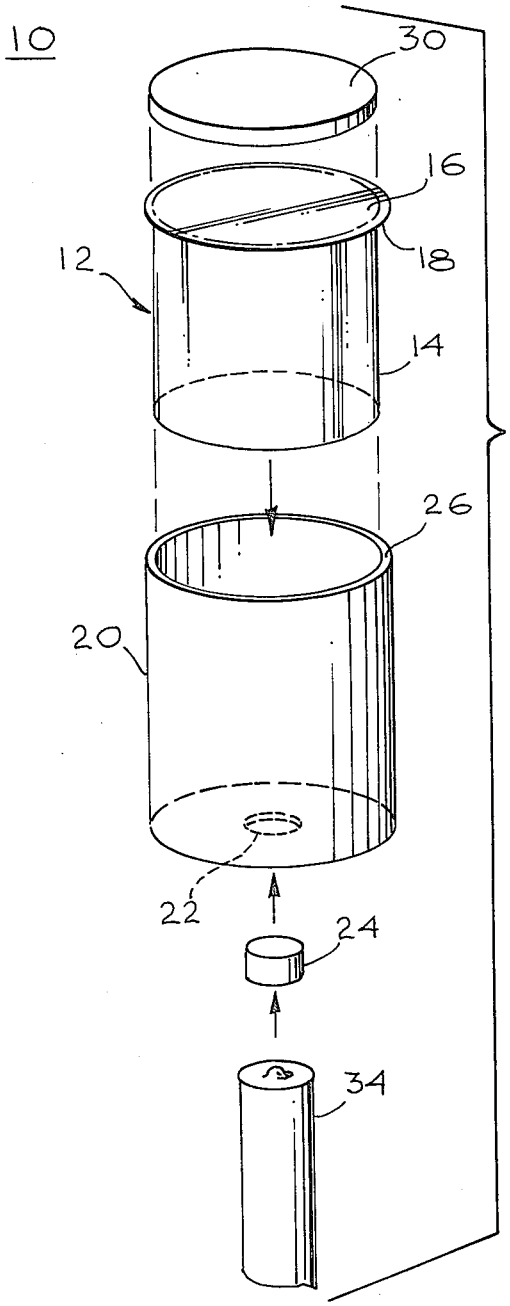
FIG. 1 is an exploded view of a packaging kit in accordance with the present invention.
Figure 2:
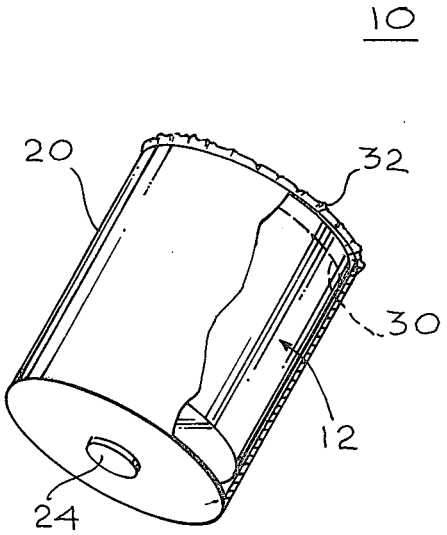
FIG. 2 is a perspective view, partially broken away, of the kit of FIG. 1 as assembled.

As best shown in FIGS. 1 and 2, the first embodiment of the invention is shown comprising a thin pre-formed Mylar cup 14 which is filled with pyrotechnic materials (not shown) to the desired bulk density. This is such that when the lid is affixed to the cup, the interior volume is entirely filled with a predetermined packing of the pyrotechnic materials content so that the granules of the material are prevented from moving with respect to each other. A lid or cover 16 is shown affixed to the cup 14. This cover 16 may be also of Mylar or polyethylene. The cup 14 is provided with an outwardly extending lip about its upper edge and the cover is affixed to the cup along this lip by adhesive bonding, heat sealing, or ultrasonic welding. After the cup 14 has been filled and the cover 16 attached in the manner described to develop a pyrotechnic material containing unit or package 12, the unit is inserted into a casing 20. This casing 20 is of a generally cylindrical shape and has a bottom in which is shown a round aperture 22. The container 20 is preferably fabricated of thicker plastic or of thin metal possessing the desired rigidity to support the cup and contents therein. The inside diameter of the container 20 is only slightly larger than the outer diameter of the cup 14 so that the cup can be slid into the container 20 without difficulty but is retained therein without substantial movement inside the container 20.

The aperture 22 in the bottom of the container 20 is shaped and sized to mate with a pyrotechnic primer cap 24 which is inserted therein with frictional engagement. The lip 18 of the cup 14 rests on the upper circumferential edge 26 of the container 20, after insertion, and this lip 18 serves to maintain a desired separation of the cup 14 from the primer cap 24 when the cup is fully inserted into its final position. As a final step in the fabrication of the pyrotechnic sub-assembly 10, a plug 30 is pressed downward against the cup 14 and lid 16, pushing the inner package slightly farther into the container 20 to the position shown in FIG. 2. In doing so, the plug 30 deforms the lip 18 and adjacent portion of the cover 16 and develops a frictional fit between the outer periphery of the plug 30, the inner surface of the casing 20 and the lip portion 18 which is engaged between the plug and the container. Insertion of the plug in this fashion leaves a scalloped edge 32 of the upper portion of the pyrotechnic package 12. Thereafter, as a final step in the sub-assembly fabrication process, this edge 32 is trimmed from the unit 10 and the sub-assembly is ready for transport to the production line and insertion in a training round for which it is intended. As shown in FIG. 1, a firing pin 34 would be provided in the training round for detonating the primer cap 24 at the appropriate time, upon impact of a training round with a target, to initiate the pyrotechnic ignition train.

Figure 3:
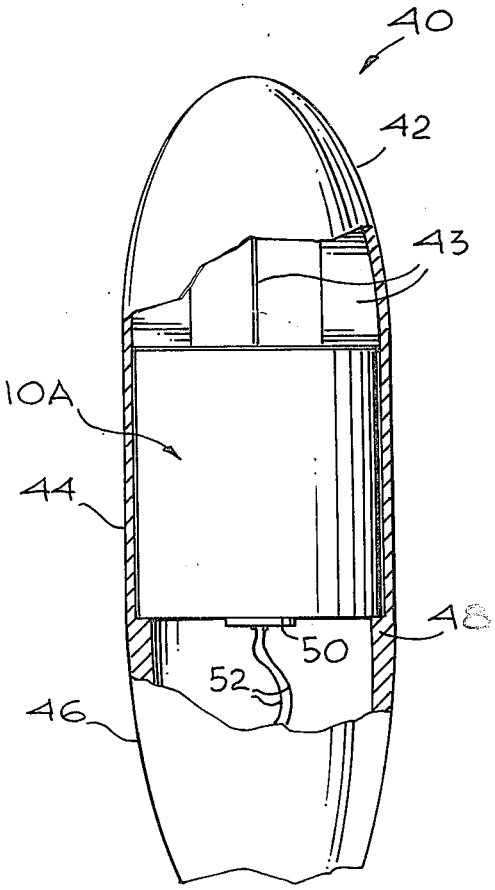
FIG. 3 is a schematic view, partially broken away, showing the pyrotechnic device of the invention mounted in place within a training round.

FIG. 3 shows the manner in which the pyrotechnic materials package of the present invention is mounted for use within a training round 40, shown partially broken away for illustration of details. The second embodiment of the present invention, shown in FIG. 3, differs from the embodiment of FIGS. 1 and 2 only with respect to the type of igniter which is employed.

The sub-assembly 10A of the FIG. 3 is like the unit 10 of FIG. 2 except for the aforementioned difference with respect to the igniter and the fact that the scalloped edge 32 of the internal package cup and lid has been trimmed off. The training round 40 is shown as comprising a nose section 42 in which a set of vanes 43 are arranged in egg crate fashion to assist in supporting the pyrotechnic package unit 10A, which is mounted within a mid portion 44. Immediately to the rear of the sub-assembly 10A is a section 46 having means in the form of a shoulder portion 48 for supporting the package 10A to bear against the vanes 43 of the forward section so as to prevent jostling of the package 10A during handling of the round 40 and during firing of the rocket propellant (not shown) of the round 40 and flight to the target. The package 10A is shown with an electrically ignited squib 50 having a pair of wires 52 coupled to an ignition control circuit (not shown).

From the above disclosure, it will be appreciated that arrangements in accordance with the present invention provide a clearly superior solution to the problem of fabricating and installing pyrotechnic material packages in training rounds or the like which are necessarily produced in quantity on a manufacturing assembly line. Indeed, arrangements in accordance with the present invention as disclosed herein are the only ones known which present the capability of dealing with the stated problem to the extent that the hazards associated with the manufacturing process are reduced to acceptable levels by virtue of the configuration of the structural components employed in the invention and the manner of packaging the pyrotechnic materials. The contents of the package are constrained against frictional movement which is likely to develop heat or static electricity sufficient to set off the pyrotechnic charge, both during the manufacturing process and during handling in the field.

Although there have been described above specific arrangements of a packaging kit for pyrotechnic materials loading in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

I claim:

1. A packaging kit for pyrotechnic materials which comprises:

a preformed cup of generally cylindrical configuration, closed at the bottom and open at the top, having a radially outwardly projecting lip extending about the open end;

a sheet-like cover for hermetically sealing the cup by attachment about the periphery of the cover to the cup lip after the cup is filled to a preselected bulk density with pyrotechnic materials;

a cup-like casing of configuration and dimension selected to receive the preformed cup therein with minimal spacing between the inner surface of the casing wall and the outer wall surface of the cup, said casing being of substantially rigid construction for protecting the cup and its contents against deformation or rupture from forces normally encountered in the handling of the cup and casing combination, the casing being longer than the cup by a predetermined dimension with a selected spacing between the bottom of the cup and the bottom of the casing being maintained by virtue of the lip of the cup engaging the upper end of the casing;

a casing plug for insertion in the open end of the casing to push the cup a predetermined distance into the casing and to retain the cup in said position within the casing by crimping of the cup lip and outer cover portion between the plug and the casing; and means defining an opening in the bottom of the casing for receiving an igniter in a position adjacent to but spaced from the bottom of the cup within the casing.

2. The kit of claim 1 wherein said preformed cup is fabricated from a deformable plastic material.

3. The kit of claim 2 wherein the plastic material is polyester film.

4. The kit of claim 2 wherein said cover is fabricated from a deformable plastic material.

5. The kit of claim 4 wherein said plastic material of the cover is polyethylene.

6. The kit of claim 4 wherein the plastic material of the cover is polyester film.

7. The kit of claim 1 further including an igniter mounted in the opening in the bottom of the casing in position adjacent the bottom of the cup suitable for firing the pyrotechnic materials within the cup when the igniter is activated but spaced a sufficient distance from the bottom of the cup to preclude contact between the igniter and the cup during normal handling of the completed package.

8. The kit of claim 7 wherein the igniter comprises a primer cap.

9. The kit of claim 7 wherein the igniter comprises an electrically actuable squib.

10. A pyrotechnic materials package comprising:

a preformed cup of generally cylindrical configuration, open at the top and closed at the bottom, and having a radially outwardly projecting lip extending about the open end;

an amount of pyrotechnic materials within said cup sufficient to fill the cup to a predetermined bulk density of material when the cup is closed;

a disc-like cover hermetically sealed to the cup by joining the outer periphery of the cover to the cup lip;

a generally cylindrical casing being open at one end and closed at the other, said casing containing the cup in close proximity to the inner wall of the casing with the lip of the cup being constrained adjacent the open end of the casing to retain the cup in position within the casing;

a plug inserted in the open end of the casing, bearing against the cover and crimping the lip of the cup and outer periphery of the cover between the periphery of the plug and the adjacent inner wall of the casing;

means in the closed end of the casing defining an opening for receiving an igniter; and an igniter fixedly positioned in said opening, the casing being sufficiently longer than the cup to position the igniter adjacent to but spaced from the bottom of the cup.

11. The device of claim 10 wherein the cup is of thin deformable material and the casing and plug are of relatively rigid material suitable for protecting the cup and cover against impact or rupture.

12. The device of claim 11 wherein the materials of the cup and cover are polyester film.

13. The device of claim 10 wherein the igniter is a primer cap which is ignitable by mechanical impact.

14. The device of claim 10 wherein the igniter is an electrically actuable squib.

15. The device of claim 10 further including a training round in which the package is mounted for use, said training round having a nose portion forward of the device, a rearward portion aft of the device and a mid section in which the device is positioned, the forward and rearward portions having means for retaining the device within the mid section.

16. The method of fabricating a pyrotechnic materials package comprising the steps of:

selecting a preformed cup of generally cylindrical configuration, open at the top and closed at the bottom, and having a radially outwardly projecting lip about the open end;

filling the cup with a predetermined charge of pyrotechnic material to develop a selected bulk density of contents when the package is closed;

selecting a thin plastic cover and hermetically sealing the cup by attachment of the periphery of the cover to the lip of the cup;

placing the sealed cover and cup with contents into a generally cylindrical casing configured and dimensioned, relative to the cup, to support the cup therein;

pushing the cup into the casing by means of a plug dimensioned to crimp the outwardly projecting lip of the cup and periphery of the cover between the periphery of the plug and the inner wall of the casing;

trimming those portions of the lip and cover which protrude from the closed plug and casing assembly; and mounting an igniter in the bottom of the casing in position to fire the pyrotechnic materials contents upon actuation of the igniter.

17. The method of claim 16 further including placing the assembled pyrotechnic materials package at a selected position within a projectile and applying means for retaining the package in said position.

* * * * *